United States Patent [19]

Files et al.

[11] Patent Number: 4,640,024

[45] Date of Patent: Feb. 3, 1987

[54] APPARATUS FOR TREATING CLOTH GOODS

[75] Inventors: William C. Files, Destrehan; Norvin L. Pellerin, New Orleans; Somsak S. Rodboon, Kenner; Thomas M. Pearce, River Ridge, all of La.

[73] Assignee: Pellerin Milnor Corporation, Kenner, La.

[21] Appl. No.: 656,767

[22] Filed: Oct. 1, 1984

Related U.S. Application Data

[63] Continuation-in-part of Ser. No. 578,704, Feb. 9, 1984, abandoned.

[51] Int. Cl.[4] ..... F26B 11/04

[52] U.S. Cl. ..... 34/133; 34/135; 34/137

[58] Field of Search ..... 34/133, 136, 137, 139, 34/109

[56] References Cited

U.S. PATENT DOCUMENTS

| | | | |
|---|---|---|---|
| 2,643,463 | 6/1953 | Grantham | 34/45 |
| 2,802,283 | 8/1957 | Strike | 34/87 |
| 2,852,236 | 9/1958 | Jackson | 259/1 |
| 3,020,648 | 2/1962 | Strike | 34/133 |
| 3,067,986 | 12/1962 | Grantham | 259/3 |
| 3,316,658 | 5/1967 | Strike | 34/126 |
| 3,419,969 | 1/1969 | Freze | 34/126 |
| 3,902,254 | 9/1975 | Files | 34/126 |
| 4,015,930 | 4/1977 | Grantham | 432/105 |

FOREIGN PATENT DOCUMENTS

| | | | |
|---|---|---|---|
| 504967 | 8/1930 | Fed. Rep. of Germany | 34/109 |
| 2303980 | 8/1974 | Fed. Rep. of Germany . | |

*Primary Examiner*—Larry I. Schwartz

*Attorney, Agent, or Firm*—Vaden, Eickenroht, Thompson & Boulware

[57] ABSTRACT

There is disclosed a tumble dryer wherein the space between a housing and a drum mounted within the housing for rotation about a generally horizontal axis is separated intermediate the ends of the drum into one portion on one side and another portion on the other side of the portion, and heated air is circulated from an inlet to the one space portion into the drum and out the drum into an outlet from the other space portion. There are also disclosed alternate embodiments of means for separating the space including a plastic ring having an inner diameter closely surrounding the drum and an outer portion carried by a wall of the housing and received within an annular recess of the wall.

35 Claims, 15 Drawing Figures

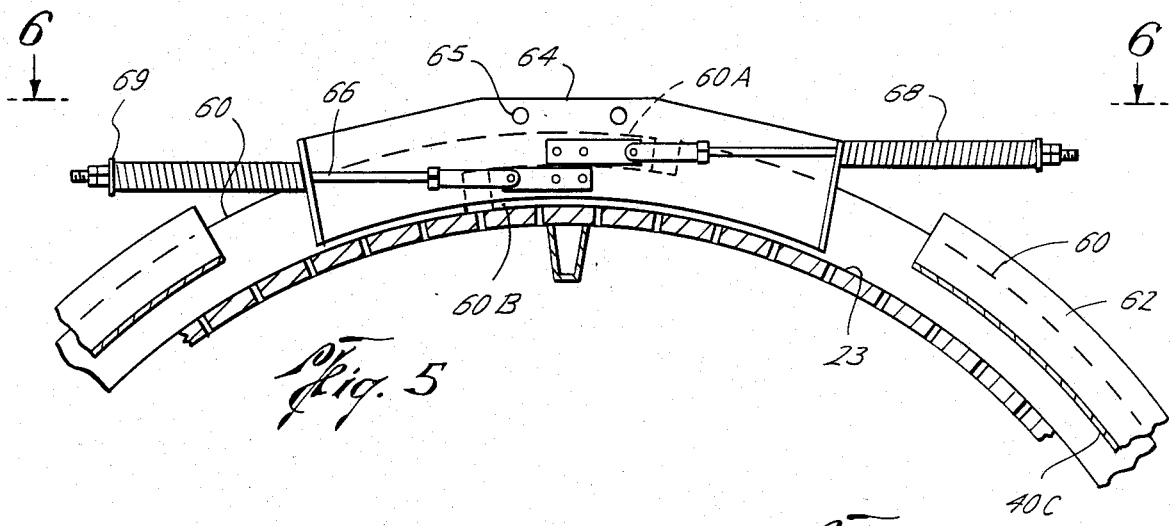
Fig. 5
Fig. 6
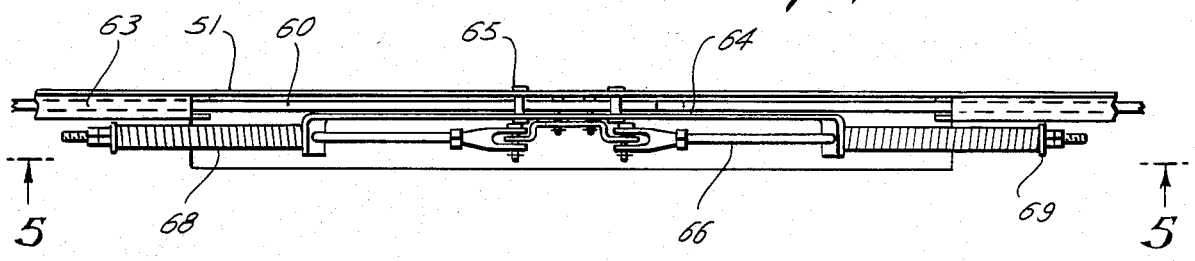
Fig. 7
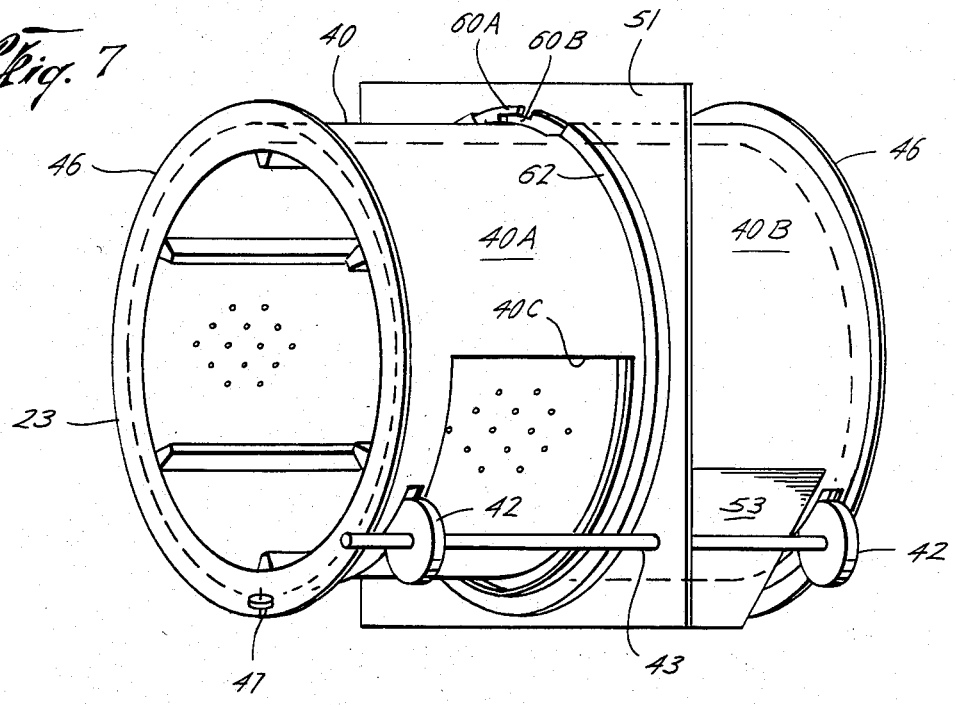

Fig. 11
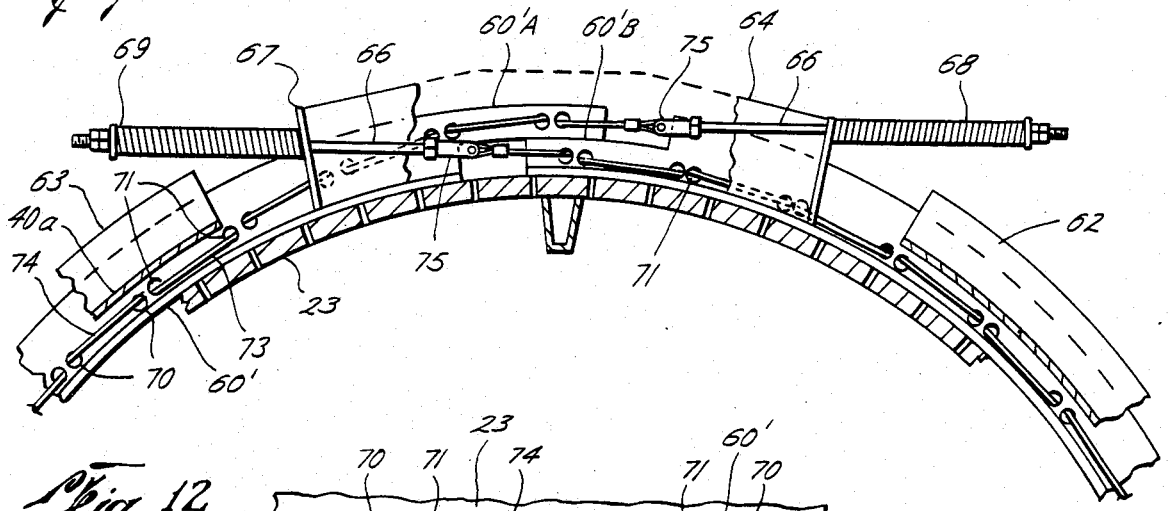
Fig. 12
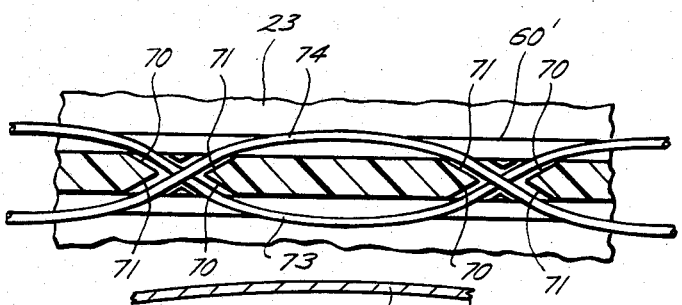
Fig. 13
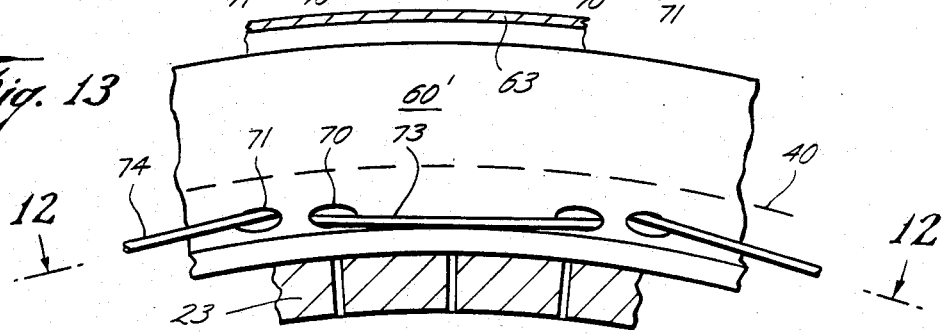
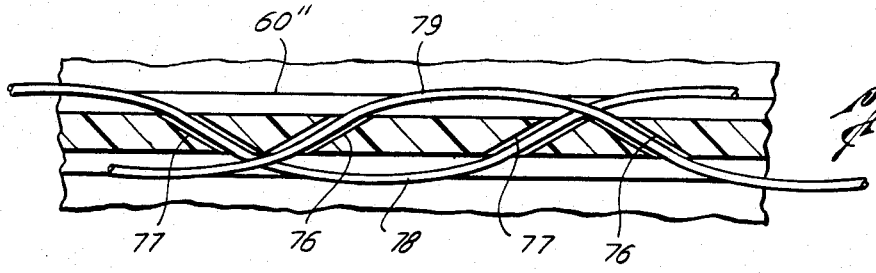
Fig. 14
Fig. 15
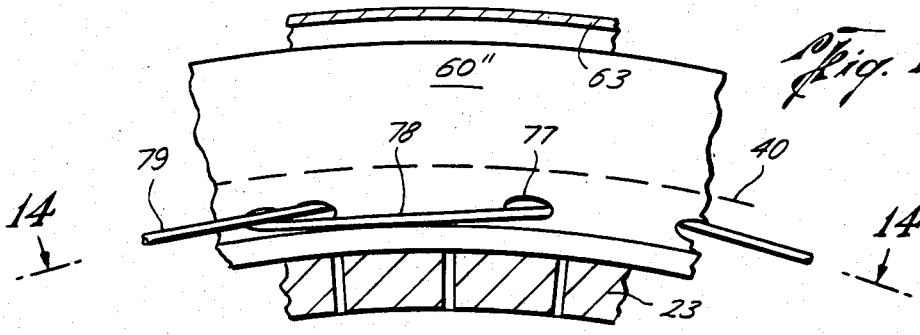

APPARATUS FOR TREATING CLOTH GOODS

This application is a continuation-in-part of our copending application, Ser. No. 578,704, filed Feb. 9, 1984, now abandoned and entitled"Tumble Dryer".

This invention relates generally to apparatus for treating cloth goods or the like in which the goods are adapted to be contained in a drum rotatably mounted within a housing in which a treating fluid is contained, and such fluid is caused to be circulated through the drum and thus through the cloth goods in order to treat them as desired. In one of its aspects, this invention relates to improvements in tumble dryers wherein heated air is circulated through the goods as they are"-tumbled" within a drum which is rotated within a housing about a generally horizontally disposed axis. In other of its aspects, it relates to improvements in substantially closing off an annular space between a wall of the housing which surrounds the drum of the dryer, or a cylindrical surface of the drum of other apparatus of this type, to define on one side thereof a portion of a space about the drum and within the housing in which the heated air or other treating fluid is contained.

In some prior dryers of this general type, the cylindrical wall of the durm is perforated to permit heated air to be circulated laterally through the drum and thus the goods from an inlet to a space about one side of the drum to an outlet from a space between the drum and housing about an opposite side of the drum. For this purpose, the inlet and outlet connect with housing ducts which are curved to fit about a wide area of the cylindrical wall of the drum. However, due to its eccentricity during rotation, the drum wears the edges of the ducts and heated air is free to bypass the drum. Also, of course, the ducts are of complex and expensive construction.

In other tumble dryers of this general type, heated air is caused to enter one end and exit through the other end of the drum, and thus circulate axially rather than laterally through the drum and the goods. Since the wet goods tend to collect along the bottom of the drum, much of the heated air bypasses them as it passes through the drum. Also, the end portions of the housings through which the air must pass to and from the interior of the drum is severely restricted, and the housing must be long in order to provide an inlet and outlet through its opposite end portions.

It has also been proposed to facilitate loading and unloading of the drums of dryers of this general type by mounting the drum for tilting about a horizontal axis perpendicular to its axis of rotation between a horizontal position during drying and a tilted position when rotation of the drum is halted during unloading or loading, or both. Thus, following drying, the drum may be tilted downwardly to cause the goods to slide gravitationally through an outlet opening in the lower end of the drum. This however requires complex and expensive mechanisms for tilting the drum as well as controls for coordinating the tilting with the loading and unloading operations.

It has also been found that in those dryers in which air flows through them, the perforations in the cylindrical wall of the drum may be clogged by plastic articles, such as bags, utensils or the like, which melt and stick to the hot cylindrical wall. This of course restricts air flow through the drum and thus reduces the efficiency of the drum. Also, it is extremely difficult and expensive to remove the plastic from the drum.

An object of this invention is to provide a dryer of this type which is of such construction that the heated air has substantially greater contact with the wet goods.

Another object is to provide such a dryer which is of relatively simple and compact construction, both from side-to-side and from end-to-end.

A further object is to provide such a dryer in which unloading of the dried goods is facilitated without the need for tilting the drum between alternate positions.

Yet another object is to provide a dryer of this general type in which heated air is caused to pass through perforations in the cylindrical wall of the drum, but which is of such construction as to minimize clogging of the perforations with melted plastic articles.

These and other objects are accomplished, in accordance with the illustrated embodiment of the invention, by a tumble dryer of the type described wherein the space between the housing and drum is separated intermediate the ends of the drum to define one portion on one side of the separation and another portion on the other side of the separation. More particularly, the housing has an air inlet to the one space portion and an air outlet from the other space portion, and the drum has means connecting its interior with each space portion whereby heated air may be circulated from the inlet through the one space portion and into the drum and out of the drum and through the other space portion to the outlet.

In accordance with the preferred and illustrated embodiment of the invention, the drum is mounted for rotation within the housing about an axis which is inclined at a relatively small angle with respect to the horizontal, and the air inlet connects to the lower of the space portions and the air outlet with the upper of the space portions. Thus, heated air passes through wet goods which have gravitated toward the lower end of the drum prior to passage of the air axially through the drum from one end to the other and thus before its heat is dissipated. At the same time, however, and as will be understood from the description to follow, the inclination of the drum is useful in permitting goods to be unloaded from its lower end, but without the need for expensive mechanisms to move it between tilted and horizontal positions.

Preferably, the air inlet is beneath the drum and the means for circulating the heated air includes air blower means above the housing, and the housing includes means connecting the air outlet with the air blower means. More particularly, the air circulating means includes a fresh air duct beneath the housing which is open at one end and connects at the other end with the inlet, and a heat source in the duct near its open end and beneath the upper space portion. Thus, the side-to-side dimensions of the dryer need not be substantially greater than the lateral dimensions of the drum itself.

The interior of the drum is connected with both space portions by perforations in the cylindrical wall of the drum, and the ends of the drum are closed during rotation, so that the heated air passes radially into and out of the drum, and the housing need not be substantially longer from end-to-end than the drum. More particularly, the ends of the drum and the housing are open, and doors on the housing are movable between positions covering and uncovering the housing and drum openings, so that goods may be loaded through the upper ends and unloaded from the lower ends when the drum is not rotating.

In accordance with another novel aspect of the present invention, the housing includes an inner portion which surrounds the upper space portion about the drum and is open below the drum to define the air outlet, and an outer portion including a wall spaced above the inner portion and opening to the exterior of the drum through the air blower means. Thus, hot air leaving perforations in the top of the drum must pass downwardly within the upper space portion in order to pass into the outlet and thus out of the drum, such that the goods do not concentrate in the top of the upper end of the drum and thus prevent free flow of heated air therethrough.

In accordance with still a further novel aspect of the invention, an annular portion of the cylindrical wall of the drum intermediate the perforations connecting with the space portions is imperforate so as to provide a heat sink to which plastic articles will adhere. Thus, there is less clogging of the perforations, and melted plastic may be removed from the drum with relative ease. More particularly, the space portions are separated by a ring having an inner diameter which fits tightly about the outer side of the annular, imperforate portion of the drum, and an outer portion which is received within an annular recess about an opening through a wall of the housing which separates the space portions. More particular, the sides of the ring is carried by the wall of the housing with the outer portion of the ring received closely within the sides of the recess and the outer end thereof spaced from the end of the recess to permit eccentric rotation of the drum with respect to the housing without excessive wear on the ring.

As shown in the aforementioned copending application, the ring is split and has overlapping ends which are pulled in opposite directions by means of springs acting between rods extending from the ends of the ring and flanges fixed to opposite ends of a mounting bracket on the wall. More particularly, the rods are pivotally connected to the ends of the ring by clevises having pins which extend laterally through the overlapping end portions of the ring.

A similar arrangement has been used to connect the ends of a ring which closely surrounds a cylindrical flange about an end opening of a drum rotatable within a housing of a continuous batch type washing machine. Thus, in such a machine, the housings and drums are arranged as modules in end-to-end relation, and batches of cloth goods are transferred from one drum to the next upon completion of each phase of the washing cycle in the adjacent drums. The outer portion of the ring is received in a recess in one end wall of the housing to confine water on other liquor which is contained within the housing for circulation through goods within the drum which rotates within the housing. As in the case of the dryer drum, each drum of the machine has same freedom of radial movement, as it rotates within the housing, without excessive wear on the inner diameter of the ring.

Since the temperature of the water or other liquor is relatively low, the ring within the washing machine may be made of a relatively inexpensive, low friction plastic material, such as polyethylene. However, air which is circulated through the dryer drum may be in the order of 400° F., and it is therefore necessary to make the ring of Teflon or other high temperature resistant material. Although Teflon is also desirable for this use, or for that in a washing machine, because it is self-lubricating, and thus subject to less wear, it is not strong in tension at these temperatures. That is, the Teflon might soften to the point that the clevis pins would pull through its ends and thus not hold the ring closely about the drum.

It is therefore another object of this invention to provide a tumble dryer or other apparatus of this general type having means for holding such a ring of Teflon or similar material closely about its rotatable drum even though the temperature of the air or other treating fluid is at such a high level.

This and other objects are accomplished, in accordance with the further illustrated embodiments of this invention, by means of a tumble dryer or similar apparatus of this type in which the ring has a least one set of holes formed therethrough at spaced locations along its length, with alternate holes extending in opposite diagonal directions, and at least one wire laced successively through alternate holes to extend alternately over opposite sides of the ring. More particularly, a means is provided for connecting the ends of the wire to the wall of the housing in which the annular recess is formed so as to pull the overlapping ends of the ring in opposite directions and thus hold the inner diameter of the ring close about the cylindrical surface of the drum as the drum rotates within the housing. As in the prior apparatus above described, the sides of the ring are received closely within opposite sides of the recess so as to substantially close the annular space between the annular recess and the cylindrical wall of the drum, and the outer end of the ring is spaced from the outer end of the recess so as to permit limited radial movement between the drum and the recess. Consequently, as in the previously described apparatus, there is a minimum of wear between the ring and the drum which rotates within it, despite eccentricities in the longitudinal axis of rotation of the drum which are known to exist in apparatus of this type.

A ring held about the cylindrical surface of the drum in this manner may be made of Teflon or similar heat resistant material, despite its low resistance to tensile forces, because, with the holes arranged in the manner described only a relatively small component of the tensile force on the wire is transmitted to the ring in a longitudinal direction. In addition, of course, even if the ring is severed, whether due to tearing by the wire or otherwise, the inner diameter of the ring will nevertheless he held in close contact with the cylindrical surface of the drum.

In the preferred embodiments of the invention, the ring has another set of holes formed therethrough at spaced locations along its length, with the alternate holes also extending in opposite diagonal directions, and another wire is also laced successively through the alternate holes of the other set to extend over opposite sides of the ring. More particularly, the ends of both wires are connected to one another as well as to the wall of the housing so that both wires serve to hold the inner diameter of the ring close about the cylindrical surface of the drum. This use of wires extending over oppositely facing sides of the ring is believed to stabilize lateral forces on the ring due to bearing of the wire against the sides of the holes through the ring.

In each of two preferred embodiments of the invention, the holes of each set are equally spaced and substantially adjacent a hole of the other set, and both wires cross one another at adjacent holes of the sets of holes so that they extend over substantially opposite sides of the ring substantially coextensively of one another. In one such embodiment, the holes of both sets cross one another generally intermediate the sides of the ring, while in another illustrated embodiment, the holes of both sets substantially intersect one another at alternate sides of the ring.

Since a ring havings its ends connected in this manner is less prone to being torn by tensile stresses from the wires, the invention contemplates that it may be made of Teflon or suitable material which has high temperature resistance, as is required for example in a tumble dryer, and is self-lubricating but which has low resistance to tension. The ring is preferably "T" shaped in cross section having a wide inner side forming its inner diameter, and the holes are formed in the thin web of the ring substantially intermediate its inner diameter and the open end of the recess, so that the wire or wires laced through the holes do not interfere with radial movement of the drum with respect to the housing. Thus, it is not necessary to make the spaces between the sides of the ring and the sides of the recess large enough to receive the wires.

In the drawings, wherein like reference characters are used throughout to designate like parts:

FIG. 5 is an enlarged side elevational view of the portion of the dryer indicated by the circle "5" on FIG. 3, and shows a bracket for mounting the ring on the housing;

FIG. 6 is is a top view of the bracket of FIG. 5, as seen along broken line 6—6 of FIG. 5;

FIG. 7 is a perspective view of the drum and an inner portion of the housing of the dryer removed from within an outer portion of the housing;

FIG. 11 is an enlarged sectional view of a portion of the dryer, similar to FIG. 5, but showing the ring held closely about the drum in accordance with a preferred embodiment of the invention;

FIG. 12 is a further enlarged longitudinal sectional view of the ring of FIG. 1, as seen along broken lines 12—12 of FIG. 13, showing the manner in which wires are laced through the holes in the ring;

FIG. 13 is a side view of the ring and wires of FIG. 12;

FIG. 14 is a view of a ring, similar to FIG. 12, and as seen along broken lines 14—14 of FIG. 15, but showing wires laced through holes in the ring in accordance with another preferred embodiment of the invention; and FIG. 15 is a side view of the ring and wires of FIG. 14.

Figure 1:
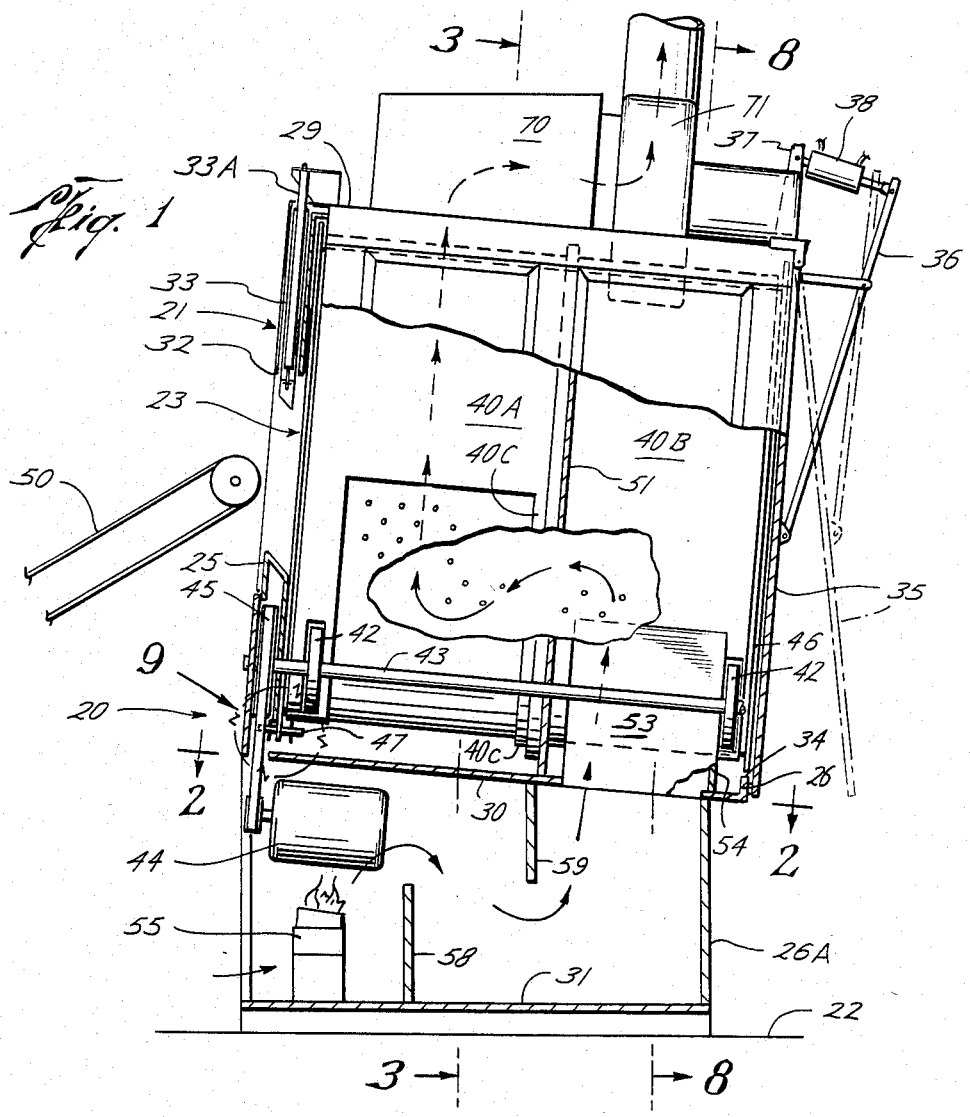
FIG. 1 is a view, partly in side elevation and partly in vertical cross section, of a dryer constructed in accordance with the present invention, and having arrows showing the path of heated air through the dryer.
Figure 2:
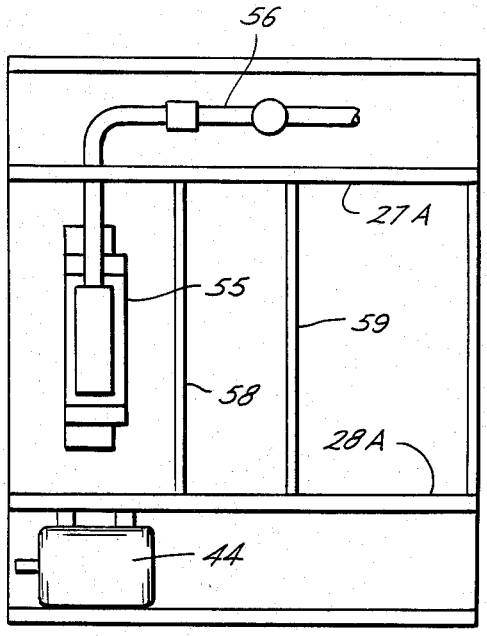
FIG. 2 is a cross-sectional view of the dryer, as seen along broken lines 2—2 of FIG. 1, showing a gas burner in the fresh air duct beneath the housing.

With reference now to the details of the above-described drawings, the overall dryer, which is indicated in its entirety by reference character 20, includes a housing 21 supported above a surface 22, and an open-ended drum 23 mounted within the housing for rotation with respect thereto about a generally horizontal axis. More particularly, the housing 21 includes an outer portion having front and rear walls 25 and 26, side walls 27 and 28, and top and bottom walls 29 and 30. The bottom wall of the outer housing is supported above the surface 22 by a base having a bottom wall 31, side walls 27A and 29A, an open front end 25A and a rear wall 26A, whose lower ends support wall 31 above the surface 22.

The top and bottom walls 29 and 30 of the upper housing portion are inclined at a small angle with respect to the horizontal, and as will be described, drum 23 is mounted within the upper housing portion for rotation about an axis which extends at the same angle. The front wall 25 of the outer housing has an opening 32 opposite the open upper end of the drum, and the rear wall 26 of the outer housing has an opening 34 opposite the open lower end of the drum. The opening 32 and thus the upper end of the drum are adpated to be covered and uncovered by means of a door 33 mounted within a pocket formed within the front wall and vertically movable therein in response to a fluid actuator 33A. The opening 34 and thus the lower end of the drum are adapted to be opened and closed by means of a door 35 pivotally mounted on the housing, as will be described. Thus, wet goods on a conveyor 50 may be loaded into the drum through opening 32 when door 33 is open, and may be unloaded therefrom through opening 34 when door 35 is open.

The upper edge of door 35 is pivotally mounted on the housing for swinging between a closed position, as shown in solid lines in FIG. 1, and an open position, as shown by broken lines in FIG. 1. An operator for so moving the door includes an arm 36 connecting the door to a reciprocable actuator 38 supported on a bracket 37 on the housing. As shown in FIG. 1, the actuator may be extended to swing the door against the outer side of wall 26 of close opening 34, or contracted to swing the door to a position in which dried goods may slide out of the lower end of the drum.

The drum 23 extends from one end to the other of the housing to dispose its opposite ends adjacent the front and rear walls, and is supported within and rotated with respect to the housing by means of rollers 42 near each end and on opposite sides of the lower half of the drum. These rollers are mounted on shafts 43 which extend lengthwise of the drum and have their opposite ends journaled in the front and rear walls 25 and 26 of the housing. At least one of the shafts is driven by means of an electric motor 44 mounted beneath the wall 30 of the housing and outside of the wall 28A and connected by a belt 34 to a sheave on one end of the shaft, as shown in FIG. 1.

Each end of the drum has an outwardly extending flange 46 thereon, with the flange on its upper end facing the inner side of adjacent front wall 25 of the housing, and with the flange on its lower end fitting within opening 34 in rear wall 26 of the outer housing. The flange on the upper end of the drum may carry a seal for sliding engagement with the wall 25, and the flange on the lower end thereof is adjacent to the door 35 when closed. The drum is held against axial movement with respect to the housing by means of a roller assembly comprising a pair of rollers 47 mounted on a bracket 48 in the housing in position to engage opposite sides of the flange 46 on the upper end of the drum.

The housing 21 includes an inner portion having a shell 40 which extends for the length of the drum intermediate its flanges 46, and which includes arcuate sections 40A and 40B disposed in spaced-apart relation about the upper and lower ends, respectively, of the drum. A duct 52 connects a hole in bottom wall 30 of the outer housing with an opening in the bottom of arcuate portion 40B to form an inlet to the space about the drum, and an opening 40C in the bottom of arcuate portion 40A forms an outlet from the space about the drum.

The inner housing portion also includes a transverse wall 51 which extends between shell 40 intermediate portions 40A and 40B and the side walls 27 and 28 and the top and bottom walls 29 and 30 of the housing to separate the space within the housing, and the outer portion of a ring 60 of Teflon or other low friction material having an inner diameter which closely surrounds the drum is mounted closely within an annular recess 61 formed about the inner portion of the shell adjacent the wall 51 intermediate the inlet to and outlet from the space. More particularly, the cylindrical wall of the drum is perforated on both sides of the ring 60, so that, when the ends of the drum are closed during rotation, the close confinement of the ring within the recess will substantially seal between the drum and wall will substantially confine hot air entering inlet 52 to flow through the perforations into the drum to the right of ring 60 and axially through the drum and out the perforations in the drum to the left of the ring into outlet 40C.

Figure 4:
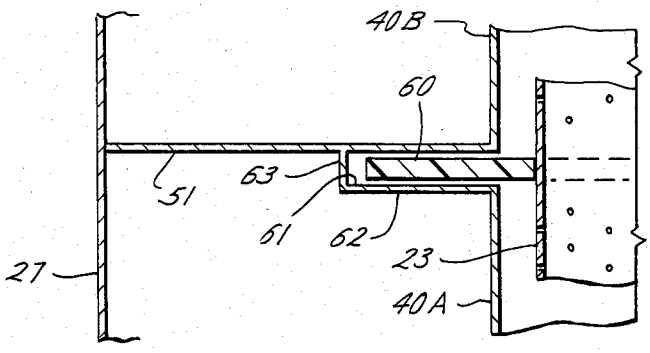
FIG. 4 is an enlarged sectional view of a portion of the housing and drum, as seen along broken lines 4—4 of FIG. 3, and showing the ring which surrounds the drum and is received in an annular recess of the housing wall which separates the space between the drum and housing intermediate their opposite ends.

As shown in FIG. 4, a wall 62 extends radially outwardly from the cylindrical wall of the shell and a flange 63 on the outer of wall 62 connects with the wall 52 to form the recess. As can also be seen from FIG. 4, the ring 60 fits closely about an unperforated annular portion of the drum, so that, for purposes previously described, such portion forms a heat sink. As shown, recess 61 is of such size that, as previously described, the ring is free to move radially with the drum during eccentric drum rotation without wear on the ring.

As shown in FIGS. 5 and 6, the wall 62 and flange 63 are interrupted adjacent the upper side of the drum and the arcuate shell portion 40A is slotted to receive a bracket 64 which connects the ends 60A and 60B of the ring 60 to one another and is mounted on the wall 51 of the inner housing by rivets 65. As will be apparent from FIGS. 5 and 6, the ends of the ring overlap and are yieldably urged toward one another to hold the ring tightly about the drum 23. Thus, rods 66 connected to each end of the ring extend through flanges 67 on the ends of the bracket, and coil springs 68 are compressed between the outer sides of the flanges 67 and spring retainers 69 mounted on the outer ends of the rods by lock nuts, whereby the force of the springs may be adjusted in order to control the extent to which the ring is tight about the drum. Thus, although the drum 23 must be free to rotate within the ring 60, the ring is nevertheless sufficiently tight about the drum that substantially all the heated air pass must move axially through the drum.

Figure 8:
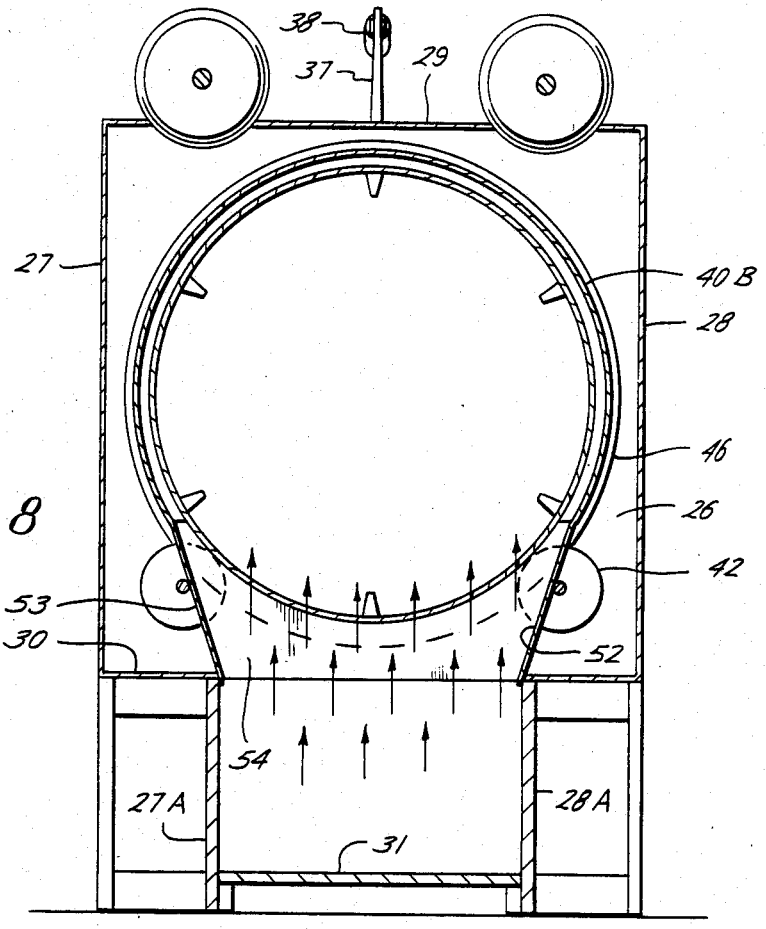
FIG. 8 is another cross-sectional view of the dryer, as seen along broken lines 8—8 of FIG. 1, and having arrows showing the direction of heated air flow through the inlet into the lower space portion about the drum.
Figure 9:
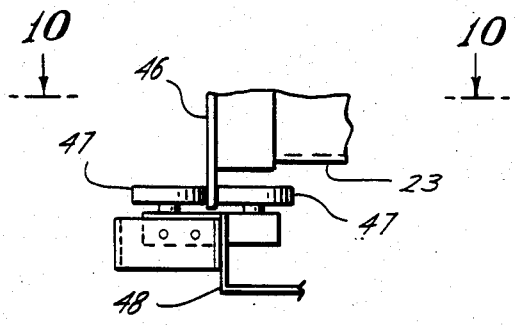
FIG. 9 is an enlarged detailed view of a portion of the drum within the circle "9" of FIG. 1, including a roller assembly which holds the drum against axial movement with respect to the housing.
Figure 10:
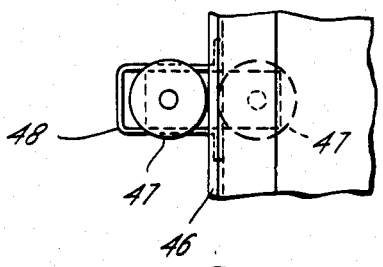
FIG. 10 is a top plan view of the roller assembly of FIG. 9, as seen along broken lines 10—10 of FIG. 9.

As best shown in FIGS. 1, 7 and 8, the duct 52 is formed by side walls 53 and end walls 54 extending downwardly from an opening in the bottom of the arcuate portion 40B to the opening in bottom wall 30. The left-hand rollers 42 extend through slots in shell portion 40A and into the upper space portion to support the upper end of the drum, and the right-hand rollers extend through slots in shell portion 40A and into the lower space portion to support the lower end of the drum.

A gas burner 55 is mounted on bottom wall 31 of the base of the housing adjacent its open left end, and gas is supplied to the burner by means of piping 56 extending thereto from a suitable source, whereby fresh air is heated before passing through the duct in the base and into the inlet 52, and thus into the lower space portion between the drum and the shell of the inner housing on the right side of ring 60. As shown in FIG. 1, a first baffle 58 extends upwardly from the bottom wall 31 of the chamber within the housing to a height above that of the burner outlets, and another baffle 59 extends downwardly from the intermediate wall 31 within the chamber to a level substantially in horizontal alignment with the upper end of the baffle 58. Consequently, the baffles cooperate to not only cause mixing of the heated air with fresh air, but also prevent any direct path between the flames of the burner and the inlet. Obviously, fresh air entering the duct may be heated by other appropriate heat sources.

Figure 3:
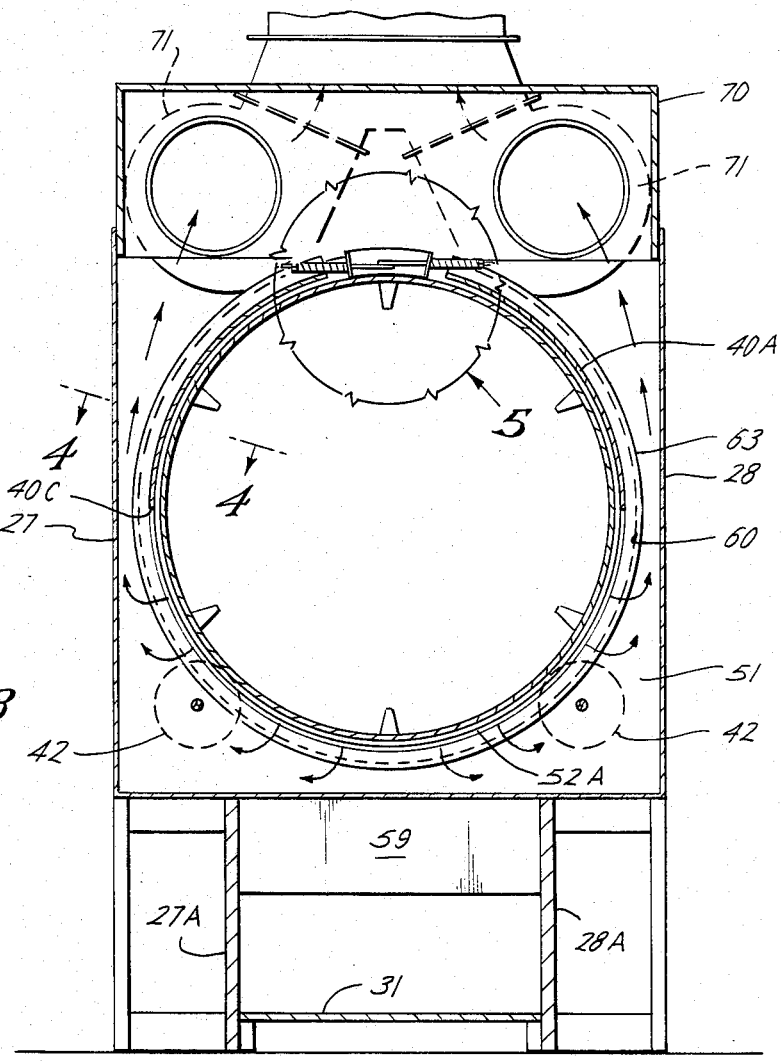
FIG. 3 is a vertical sectional view of the dryer, as seen along broken lines 3—3 of FIG. 1.

Openings are formed in the top wall 29 of the outer housing above the shell portion 40A about the upper end of the drum to the left of wall 51 so as to connect with plenums 70 mounted on the top wall and connecting at their right-hand ends with suction blowers 71 also mounted on the top wall 29 toward the rear end of the housing. As indicated by the arrows, heated air is caused to circulate from within the drum and through its perforations in the upper space portion to the left of ring 60. More particularly, and as will best be understood from FIGS. 1 and 3, heated air in the upper space portion must pass through outlet 40C therefrom and then over the top of the arcuate portion 40A to the left of wall 51 before entering the openings leading to the air blower plenum. In this way, goods are prevented from collecting in the upper portion of the left-hand end of the drum, and thus restricting air flow, before circulating into the outlet from the space portion.

The inclination of the drum with respect to the horizontal may be in the order of 7.5 degrees, and, in any case, is so well selected as to cause wet goods to slide downwardly to its lower end, but to permit dried goods to settle uniformly over the bottom of the drum under the influence of the heated air passing axially therethrough.

As previously described, in the embodiment of the means illustrated in FIGS. 12 and 13 for substantially closing the space between the outer periphery of the drum and the shell 40, the seal ring 60' is similar to seal ring 60 in that its inner diameter fits closely about the periphery of the drum 23 and its outer portion has opposite sides received closely within the sides of the recess 61 and an outer end spaced from the outer end of the recess, all as shown in FIG. 4. The ring differs in cross-section in that it is "T" shaped having a wide flange providing its inner diameter which fits closely about the drum, and a narrow web fitting within the annular recess 61. As previously mentioned, the wide flange on the inner diameter of the seal ring 60' provides a greater cross-sectional area so as to better distribute wear during rotation of the drum within the ring.

As also previously described, the overlapping ends 60'A and 60'B of the ring 60' are connected to the bracket 64 on the wall 51 in a manner which is particularly well suited for a ring made of Teflon or other plastic material having not only low friction characteristics and high resistance to temperatures which would be encountered in a tumble dryer or the like, but also low tensile strength. More particularly, the ends of the ring 60' are so connected to the bracket 64 as to retain the ring in close fitting relation about the drum 23 despite the tendency of the Teflon to soften at these elevated temperatures, and thus, if connected to the bracket in the manner previously described, possibly permit the clevis pin to pull through one or both ends.

Thus, as previously described, and as shown in FIGS. 11 and 12, the web of the ring 60' intermediate its flange and the shell wall 40A at the inner end of the recess in which the outer portion of the ring is received as first and second sets of holes 70 and 71, respectively, formed therein at spaced locations along the length of the ring, with alternate rings of each set extending in opposite diagonal directions. Thus, for example, the leftmost hole of the adjacent holes of set 70 shown in FIG. 12 extends downwardly and to the right, while the rightmost hole thereof extends upwardly and to the right. Conversely, the leftmost hole of the adjacent holes of set 71 extends upwardly and to the right, while the rightmost hole thereof extends downwardly and to the right. More particularly, a first wire 73 is laced successively through alternate holes of the first set of holes 70, a second wire 74 is laced successively through alternate holes of the second set of holes 71, whereby both wires extend alternately over longitudinally spaced portions of opposite sides of the ring—i.e., front and back as seen in FIG. 11 and top and bottom as seen in FIG. 12.

As shown in FIG. 11, the ends of the wires which extend from the endmost hole of each set of holes at each end of the ring are connected to one another, the pin of a clevis 75 extends through a loop on their connected ends. The clevis in turn is connected to a rod 66 extending through a hole in a flange 67 of the bracket, and a coil spring 68 is disposed between the outer side of the flange and a spring retainer 69 on the outer end of the rod so as to yieldably pull the ends of the ring 60' in opposite directions, as previously described in connection with the ring 60.

As shown in FIG. 12, there is preferably some slack in the wires 73 and 74, and the spring retainers 69 are adjusted accordingly. This will allow for a difference in the rate of expansion between the wires and the plastic ring 60', and thus permit the ring to be held closely about the drum 23, but not bear too tightly against the opposite sides of the holes 70 and 71, as hot air is circulated through the goods.

As shown in FIGS. 11 and 12, each hole of each set is substantially adjacent a hole of the other set which extends in the opposite diagonal direction, so that wires 73 and 74 cross one another at the adjacent holes so as to extend substantially coextensively of one another on opposite sides of the web of the ring. More particularly, as shown, the holes cross one another generally intermediate the sides of the web of the ring, and intersect one another so that the wires 73 and 74 will also be adjacent to one another as they cross within adjacent holes of the two sets.

As also previously described, in the embodiment of the means shown in FIG. 14 and 15 for substantially closing the space between the drum and shell 40, the seal ring 60" may be identical to the seal ring 60' of the embodiment of FIGS. 11 and 12 insofar as its cross-sectional shape and material are concerned, the difference between them residing in the manner in which wires are laced through holes in the web of the ring to hold the inner diameter of the ring closely about the drum 23. Thus, as in the case of the ring 60', the outer portion of the ring 60" has opposite sides which fit closely within the opposite sides of the annular recess 61, and an outer end which is spaced from the outer end of the recess so as to permit radial movement between them during rotation of the drum.

In the embodiment of FIGS. 14 and 16, however, the two sets of holes 76 and 77, are similar to those of the sets of holes 70 and 71 of ring 60' in that alternate ones of each set are equally spaced apart and extend in opposite diagonal directions, and further in that each hole of each set is substantially adjacent a hole of the other set which extends in an opposite diagonal direction. However, although being substantially adjacent alternate, the holes of one set do not cross those of the other, but instead are staggered with respect to one another in a longitudinal sense. More particularly, and as best shown in FIG. 14, the adjacent holes of each set intersect one another at alternate sides of the web of the ring. Thus, although portions of the wires 78 and 79 laced through alternate sets of holes 76 and 77, respectively, extend over opposite sides of the ring, they are not coextensive of one another, as in the case of the embodiment of FIGS. 12 and 13. Although the lateral forces on the seal ring may therefore be somewhat unbalanced, this arrangement provides a larger body of ring material over which the wires bear when their ends are urged in opposite directions to pull the inner diameter of the seal ring close about the drum 23.

As will be appreciated, the opposite ends of the wires 78 and 79 are connected to one another and to the bracket 64, as shown and described in connection with FIG. 11.

Reviewing now the overall operation of the dryer, door 33 is opened and door 35 closed to permit wet clothes or other cloth goods to be dried to be loaded into the dryer by means of the conveyor 50. Upon closing of the door 33, the drum may be rotated to tumble the goods therein and, for this purpose, there are longitudinal ribs on the inner diameter of the cylindrical wall of the drum. At the same time, the air blower is started so as to cause fresh air to be drawn over the gas burner and thereby heated as it passes through the inlet and the lower space portion into the drum, and then axially through the drum and out the performations to the left of the ring 60 (or ring 60' or 60") into the upper space portion, and from there out of the dryer through the air blower. As the drum is so rotated by means of the rollers 42, the goods will gravitate toward the lower right-hand end of the drum, and thus to a position for the heated air to pass through them as it first enters the upper housing portion. As the hot air leaves the upper end of the drum, it must pass beneath the upper edges of outlet 40A before passing into the air blower. When the goods are sufficiently dry, rotation of the drum is stopped, the gas burner extinguished, and door 35 opened to permit the dried goods to be unloaded through the lower end of the drum. As previously mentioned, the inclination of the drum will facilitate unloading through the opening in its right-hand end.

From the foregoing it will be seen that this invention is one well adapted to attain all of the ends and objects hereinabove set forth, toghether with other advantages that are obvious and that are inherent to the method and apparatus.

It will be understood that certain features and subcombinations are of utility and may be employed without reference to other features and subcombinations. This is contemplated by and is within the scope of the claims.

Because many possible embodiments may be made of this invention without departing from the scope thereof, it is to be understood that all matter herein set forth or shown in the accompanying drawings is to be interpreted as illustrative and not in a limiting sense.

The invention having been described, what is claimed is:

1. A tumble dryer, comprising a housing, drum mounted within the housing including a substantially cylindrical wall rotatable about a generally horizontal axis, means for so rotating the wall, means by which goods may be loaded into and unloaded from the drum, means separating the space between the housing and drum intermediate the ends of the drum to define one space portion on one side thereof and another space portion on the other side thereof, and housing including means providing an air inlet to the one space portion and an air outlet from the other space portion, said cylindrical wall having perforations about its circumference on both sides of the separating means for connecting the interior thereof with both space portions, means for circulating heated air from the inlet through the one space portion and into the drum through the perforations on one side of the separating means and out of the drum and through the perforations on the other side of the separating means and the other space portion to the outlet, so that the goods in the drum are directly contacted by the heated air, and means for causing goods in the drum to move toward the end thereof connecting with the one space portion while directing air from said one space portion into perforations in the bottom of the drum.

2. A dryer of the character defined in claim 1, wherein the cylindrical wall includes an annular imperforate portion intermediate perforations on its opposite sides, and the separating means includes a ring closely surrounding the annular imperforate portion.

3. A dryer of the character defined in claim 1, wherein the air circulating means includes an air blower means above the housing, and the housing includes means connecting the air outlet with the air blower means.

4. A dryer of the character defined in claim 3, wherein the air circulating means includes a fresh air duct beneath the housing which is open at one end and connects at the other end with the inlet, and a heat source within the duct near its open end and beneath the other space portion of the housing.

5. A dryer of the character defined in claim 1, wherein the means by which goods may be loaded and unloaded includes openings through the ends of the drum and housing, the housing includes doors movable between positions covering and uncovering the housing and drum openings.

6. A dryer of the character defined in claim 1, wherein the housing includes an inner portion which includes a wall surrounding the other space portion about the drum and is open below the drum to define the air outlet, and an outer portion including a wall spaced above the wall of the inner portion and opening to the exterior of the housing, whereby hot air leaving perforations in the upper portion of the drum must pass downwardly within the other space portion into the outlet before leaving the dryer.

7. A dryer of the character defined in claim 1, wherein the means for rotating the drum includes rotatable rollers engageable with the periphery of the drum.

8. A dryer of the character defined in claim 1, wherein said separating means includes a ring closely surrounding the wall, and an annular recess in the housing in which the ring is closely received for radial movement with respect thereto.

9. A tumble dryer, comprising a housing, a drum mounted within the housing including a substantially cylindrical wall rotatable about an axis which is inclined at a relatively small angle with respect to the horizontal to dispose one end above the other, means for so rotating the wall, means by which goods are loaded into and unloaded from the drum, means separating the space between the housing and drum intermediate the ends of the drum to define upper and lower space portions on opposite sides thereof, said housing including means providing an air inlet to the lower space portion and an air outlet from the upper space portion, said cylindrical wall having perforations about its circumference on both sides of the separating means for connecting the interior thereof with both space portions, means for circulating heated air from the inlet through the lower space portion and into the drum through the perforations on one side of the separating means and out of the drum and through the perforations on the other side of the separating means and the upper space portion to the outlet, so that the goods in the drum are directly contacted by the heated air, and means for directing air from said lower space portion into the perforations in the bottom of the drum.

10. A dryer of the character defined in claim 9, wherein the cylindrical wall includes an annular imperforate portion intermediate perforations on its opposite sides, and the separating means includes a ring closely surrounding the annular imperforate portion.

11. A dryer of the character defined in claim 9, wherein the air circulating means includes an air blower means above the housing, and the housing includes means connecting the air outlet with the air blower means.

12. A dryer of the character defined in claim 11, wherein the air circulating means includes an air duct beneath the housing which is open at one end, and a heat source within the duct near its open end and beneath the upper space portion of the housing.

13. A dryer of the character defined in claim 9, wherein the means by which goods may be loaded and unloaded includes openings through the ends of the drum and housing, and the housing includes doors movable between positions covering and uncovering the housing and drum openings.

14. A dryer of the character defined in claim 9, wherein the housing includes an inner portion which includes a wall surrounding the upper space portion about the drum and is open below the drum to define the air outlet, and an outer portion including a wall spaced above the wall of the inner portion and opening to the exterior of the housing, whereby hot air leaving perforations in the upper portion of the drum must pass downwardly within the upper space portion into the outlet before leaving the dryer.

15. A dryer of the character defined in claim 9, wherein the means for rotating the drum includes rotatable rollers engageable with the periphery of the drum.

16. A dryer of the character defined in claim 9, wherein said separating means includes a ring closely surrounding the wall, and an annular recess in the inner housing portion in which ring is closely received for radial movement with respect thereto.

17. A tumble dryer, comprising a housing, a drum mounted within the housing including a substantially cylindrical drum rotatable about a generally horizontal axis, means for so rotating the wall, means by which goods may be loaded into and unloaded from the drum, means separating the space between the housing and drum intermediate the ends of the drum to define one space portion on one side thereof and another space portions on the other side thereof, said housing having an air inlet to the one space portion and an air outlet from the other space portion, the ends of the drum being closed during rotation and the cylindrical wall having perforations about its circumference on both sides of the separating means which connect the interior of the drum with both space portions, means for circulating heated air from the inlet through one space portion and the perforations on one side of the separating means into the drum and out of the drum and through the perforations on the other side of the separating means and the other space portion to the outlet, so that the goods in the drum are directly contacted by the heated air, means for causing goods in the drum to slide downwardly therein in a direction from the end thereof connecting with the other space portion toward the other end thereof, while directing air from said one space portion into perforations in the bottom of said other end of the drum.

18. A dryer of the character defined in claim 17, wherein the cylindrical wall includes an annular imperforate portion intermediate perforations on its opposite sides, and the separating means includes a ring closely surrounding the annular imperforate portion.

19. A dryer of the character defined in claim 17, wherein the air circulating means includes the air blower means above the housing, and the housing includes means connecting the air outlet with the air blower means.

20. A dryer of the character defined in claim 19, wherein the air circulating means includes an air duct beneath the housing which is open at one end, and a heat source within the duct near its open end and beneath the other space portion of the housing.

21. A dryer of the character defined in claim 17, wherein the means by which goods may be loaded and unloaded includes openings through the ends of the drum and housing, the housing includes doors movable between positions covering and uncovering the housing and drum openings.

22. A dryer of the character defined in claim 17, wherein the means for rotating the drum includes rotatable rollers engageable with the periphery of the drum.

23. A dryer of the character defined in claim 17, wherein the housing includes an inner portion which includes a wall surrounding the other space portion about the drum and is open below the drum to define the air outlet, and an outer portion including a wall spaced above the wall of the inner portion and opening to the exterior of the housing, whereby hot air leaving perforations in the upper portion of the drum must pass downwardly within the other space portion into the outlet before leaving the dryer.

24. A dryer of the character defined in claim 17, wherein said separating means includes a ring closely surrounding the wall, and an annular recess in the housing portion in which the ring is closely received for radial movement with respect thereto.

25. A tumble dryer, comprising a housing, a drum mounted within the housing including a substantially cylindrical wall rotatable about a generally horizontal axis, means for so rotating the wall, means by which goods may be loaded into and unloaded from the drum, said wall having perforations about the circumference thereof on opposite sides of an annular imperforate portion, means including an annular seal ring surrounding the annular portion to separate the space between the housing and drum into one space portion to which air may be admitted and another space portion from which air may escape, and means for circulating heated air through the perforations and into and out of the drum on opposite sides of the annular portion, so that the goods in the drum are directly contacted by the heated air, said housing having a recess in which the seal ring is received for radial shifting during rotation of the cylindrical wall.

26. Apparatus for treating cloth goods, comprising a housing in which treating fluid may be contained, a drum for containing cloth goods and mounted for rotation within the housing as treating fluid is circulated therethrough, said housing including a wall having an annular recess surrounding a cylindrical wall of the drum, a split ring having an inner diameter surrounding the cylindrical surface of the drum and an outer portion having its opposite sides received closely within opposite sides of the recess and its outer end spaced from the outer end of the recess, so as to permit limited radial movement between them, said ring having at least one set of holes formed therethrough at spaced locations along its length, with alternate holes extending in opposite diagonal directions with respect to its length, at least one wire laced successively through alternate holes to extend alternately over opposite sides of the ring, and means connecting the ends of the wire to the wall so as to hold the inner diameter of the ring close about the cylindrical surface of the drum as the drum rotates within the housing.

27. Apparatus of the character defined in claim 26, including the ring has another set of holes formed therethrough at spaced locations along its length, with alternate holes extending in opposite diagonal directions with respect to its length, and another wire laced successively through the alternate holes of the other set to extend alternately over opposite sides of the ring, said connecting means also including means connecting the ends of the wires to one another.

28. As in claim 27, wherein the alternate holes of each set are generally equally spaced and each hole of each set is substantially adjacent a hole of the other set, so that the wires cross one another at adjacent holes of the sets to extend over oppositely facing portions sides of the ring.

29. As in 28, wherein the adjacent holes cross one another generally intermediate the sides of the ring.

30. As in 28, wherein the adjacent holes intersect near alternate sides of the ring.

31. As in 26, wherein the ring is "T" shaped in cross section having a wide inner side forming its inner diameter, and the wire is laced through holes in the thin web of the ring intermediate the wide side of the ring and the open end of the recess.

32. As in 26, wherein the ring is formed of a self-lubricating plastic material.

33. As in 26, wherein the plastic material is Teflon or other material having relatively high temperature resistance and low tensile strength.

34. As in 26 wherein the apparatus is a tumble dryer and said fluid is heated air which is circulated through the drum and the cloth goods therein.

35. As in 34, wherein the drum has openings therein on both sides of its cylindrical surface so that heated air may be circulate into the drum on one side of the wall and out of the drum on the other side of the wall.

* * * * *